US008632372B2

(12) United States Patent
Fleck

(10) Patent No.: US 8,632,372 B2
(45) Date of Patent: Jan. 21, 2014

(54) SWIMMING DEVICE FOR A SWIMMER OR DIVER

(76) Inventor: Norbert Fleck, Palling (DE)

( * ) Notice: Subject to any disclaimer, the term of this patent is extended or adjusted under 35 U.S.C. 154(b) by 159 days.

(21) Appl. No.: 13/038,667

(22) Filed: Mar. 2, 2011

(65) Prior Publication Data

US 2011/0217890 A1 Sep. 8, 2011

(30) Foreign Application Priority Data

Mar. 2, 2010 (DE) ..... 20 2010 000 295 U

(51) Int. Cl.
*A63B 31/08* (2006.01)

(52) U.S. Cl.
USPC ..... 441/55; 441/64

(58) Field of Classification Search
USPC ..... 441/55, 61, 64, 56
See application file for complete search history.

(56) References Cited

U.S. PATENT DOCUMENTS

| | | | | | |
|---|---|---|---|---|---|
| 1,530,560 | A * | 3/1925 | Heminger | ..... | 441/55 |
| 3,082,442 | A * | 3/1963 | Cousteau et al. | ..... | 441/64 |
| 3,405,413 | A * | 10/1968 | Manis | ..... | 441/56 |
| 4,017,925 | A * | 4/1977 | Shamlian | ..... | 441/64 |
| 4,025,977 | A * | 5/1977 | Cronin | ..... | 441/64 |
| 5,460,557 | A | 10/1995 | Arnold | | |
| 5,632,662 | A | 5/1997 | Cadorette | | |
| 6,375,530 | B1 * | 4/2002 | Earl | ..... | 441/55 |
| 6,764,362 | B1 * | 7/2004 | Wenzel | ..... | 441/64 |
| 7,086,916 | B2 * | 8/2006 | Godoy | ..... | 441/64 |
| 2007/0004295 | A1 | 1/2007 | Rocci | | |

FOREIGN PATENT DOCUMENTS

| | | | | |
|---|---|---|---|---|
| DE | 18 00 148 | U | 11/1959 | |
| DE | 34 14 408 | A1 | 10/1985 | |
| DE | 40 17 461 | C2 | 12/1991 | |
| EP | 0 063 666 | A1 | 11/1982 | |
| FR | 6 21 761 | A | 5/1927 | |
| FR | 2 612 407 | A1 | 9/1988 | |
| FR | 2612407 | A1 * | 9/1988 | ..... A63B 31/12 |
| WO | WO 98/08574 | A1 | 3/1998 | |
| WO | WO 2004/091735 | A1 | 10/2004 | |

* cited by examiner

*Primary Examiner* — Stephen Avila
(74) *Attorney, Agent, or Firm* — Muncy, Geissler, Olds & Lowe, PLLC

(57) ABSTRACT

A swimming device for a swimmer or diver is described, which has a monofin, a power transfer element for moving the monofin using muscle power, and a fastening device for fastening the power transfer element to the lower legs of the swimmer. The power transfer element has a lower leg section, a foot section, and a fin section. In order to achieve the highest possible propulsion in the water with the lowest possible use of force, the power transfer element flows dynamically, in cross section in the X-Z level with a longer Z axis and short X-axis.

23 Claims, 4 Drawing Sheets

SWIMMING DEVICE FOR A SWIMMER OR DIVER

This nonprovisional application claims priority under 35 U.S.C. §119(a) to German Patent Application No. DE 20 2010 000 295.8, which was filed in Germany on Mar. 2, 2010.

BACKGROUND OF THE INVENTION

1. Field of the Invention

The present invention relates to a swimming device for a swimmer, in particular a diver, with a monofin which is laminar on the X-Y level, and movable in the +/−Z-direction, a power transfer element for moving the monofin using muscle power in the water, comprising a fastening device for fastening a plate-like power transfer element to both lower legs of the swimmer.

2. Description of the Background Art

Monofins and swimfins for one foot used as swimming devices are well known.

A swimming device is being manufactured and distributed by Ted Ciamillo, Ciamillo Components Inc., USA, under the name Lunocet, which has two shoes mounted pivotally secured to a monofin. Speeds of up to approx. 13 km/h can be reached by this swimming device (roughly two times faster than the speed of Olympic swimmers) with straight muscle movement.

FR 26 12 407 describes a monofin which is designed elongated so that it can be rigidly fastened to the lower legs of a swimmer. The swimmer's feet are secured to the monofin at a fixed angle using fastening straps.

There is a need to improve a swimming device of the above-described type in such a way that the swimming device achieves the highest possible propulsion in the water, using the lowest possible amount of effort.

SUMMARY OF THE INVENTION

It is one idea of the invention to develop a swimming device in such a way that the water resistance is minimized as far as possible. This is of central significance since the water resistance is at the same speed 800 times higher than the air resistance. The power transfer element comprises a plate-like shin pad with form elements which is, in cross section, at a right angle to the body axis of a swimmer using one of the swimming devices, at least in the lower leg section, lenticular biconvex with the long axis in the +/−Z-direction. In this way, laminar flow conditions are created as much as possible during movement in the water, which as a consequence significantly reduces the exertion of force for movement in water, so that one can more powerfully, and quickly, execute the movement sustained for a longer amount of time. In addition, increased propulsion is generated because few braking flow conditions are allowed. The swimming device thereby models itself on the movement of swimming and diving animals, specifically on bottlenose dolphins, so that propulsion is realized which better implements bionic principles. Another feature of the invention is that the power derivation takes place starting at the lower leg, which has the advantage that the comparably very weak ligaments, tendons, and muscles of the musculus (extensor dig. longus, tibialis anterior) dorsal flexor in the ankle are not, or barely, strained.

In order to receive a laminar dynamic efficient shape, form elements and fill elements are arranged on and around the shin pad.

In order to achieve a good propulsion, the swimming device comprises a limited angle hinge, in particular hinged joint, between the power transfer element and fin.

In order to increase the laminar dynamic efficient shape, the monofin has a laminar-oval shape in the Y-Z level with a long Y-axis and a short Z-axis.

In the preferred embodiment the fin blade is largely rigid. It is preferred that the monofin can move as a whole, using a hinge, in specific angles in the +/−Z-direction.

Preferably, the power transfer element is an elastic construction so that mechanical energy can be temporarily stored using elastic forming of the power transfer element during an up and/or down movement while swimming. This allows decreasing load peaks in order to relieve the swimmer's muscular system and hinges, or also to increase the efficiency of the swimming device. In addition, a defined mechanical system is thereby created which realizes propulsion similar to that of dolphins.

According to one of the further embodiments of the invention, the power transfer element is created from a rod-like brace, preferably with varying stiffness by section. Due to the geometry of the brace cross section (i.e. rectangular, oval, round) the desired stiffness is largely adjustable to the requirements in different spatial directions.

According to an alternative embodiment, an adjusting device to vary the angle between the fin and the power transfer element is designed on the fin and the power transfer element. In this way, swimming with the swimming device can be impacted to improve the propulsion efficiency.

According to an additional preferred embodiment, the swimming device comprises an adjusting device to vary the stiffness of the fin, in particular, its mobility relative to the power transfer element. This has the advantage that the propulsion efficiency is improved at different speeds, for example similar to turbines and pitch propellers in the aviation and power plant sectors. In addition, particularly sensitive swimming manoeuvres can be realized as a result.

The above-mentioned embodiments individually, or as a whole, make it possible to optimize the ergonomics as well as the efficiency of the swimming device, for example, for different swimming situations in a simple manner.

Apart from that it is preferred that the swimming device has at least one activation device to activate at least one adjustment device, in particular, in accordance with one or both of the above mentioned embodiments, whereby, it is preferred that the activation device is designed so that it can be activated with one foot. In this way, additional functions of the swimming device like, for example, the angle and the stiffness of the fin or other effects can be controlled by the swimmer. Alternatively, the functions can be triggered by manual control.

According to an improvement in the invention, the power transfer element is designed from the torso to the fin section. This expands the musculature available to operate the fin; in particular, the strength of the thigh muscles and the muscles in the torso area can be transfer to the fin using the power transfer element in order to increase the applied force and thereby the propulsion of the swimming device.

With this improvement it is preferred that at least three, in some cases four, fastening devices are designed for fastening the power transfer element to the body of the swimmer, in order to increase the performance of the swimming device. These fastening devices should, in particular, are located in the lower leg, in the knee and hip area and especially in the shoulder area, whereby the power from the legs and the torso can be transferred to the fin in a particularly efficient manner.

At the same time, the swimmer's body is protected against excessive bending and, above all, overstressing of the lumbar vertebrae.

To improve functionality, the power transfer element can be bent in two dimensions in order to increase the performance of the swimming device, by being movable like an artificial spine. In a particularly preferred embodiment, the power transfer element can also be designed in a pre-stressed unloaded state. The pre-stressing lets the naturally different strength musculatures compensated for contrary movements, for example, for corresponding bending and/or stretching movements.

Advantageously, the swimming device comprises a suit, which, in particular, has a leg section and, preferably a torso section, in order to reduce the flow resistance while swimming. In addition, the swimming device can alternatively feature holding devices on both sides of the power transfer element, particularly pockets, preferably for breathing air supply (compressed air breathing apparatus or closed circuit rebreather).

Furthermore, the swimming device can also include a buoyancy device, in particular, with at least one container for a buoyancy medium, especially for gas, so that the swimmer or diver can adjust his/her balance and buoyancy in the water or under water. Preferably, the buoyancy device will include an adjustment device, and this adjustment device can be actuated using an activation device, especially pneumatically. In this way, a separate buoyancy compensator (which is currently not available with flow-optimized design) is superfluous.

To stabilize position under water the swimming device can include a dorsal fin.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
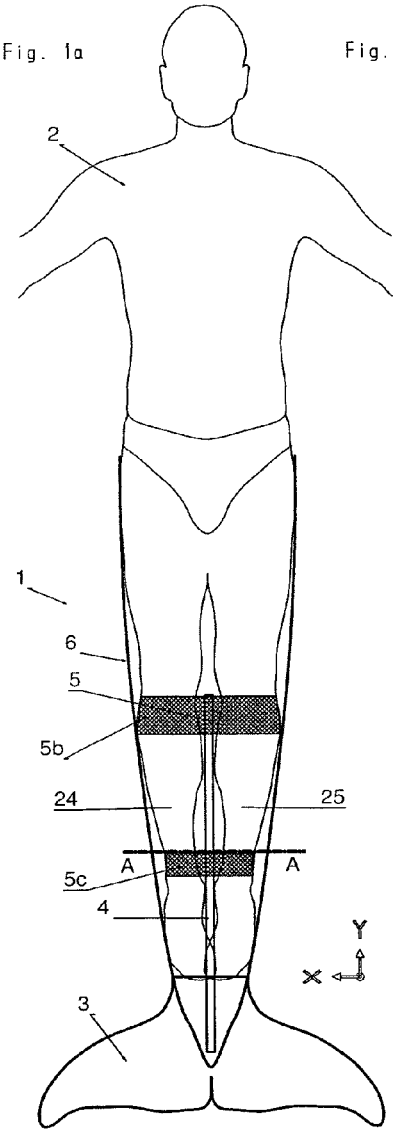
FIG. 1*a, b* illustrates a top view and a side view of a swimming device according to a first embodiment.
Figure 1B:
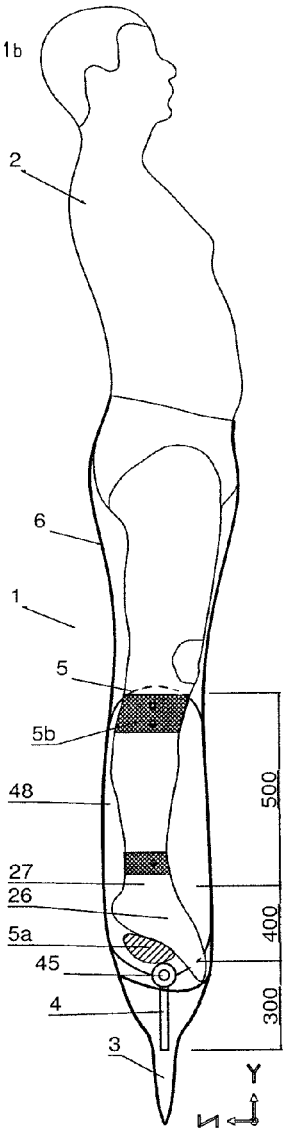
FIG. 1*c* is a cross section in the X-Z-level, FIG. 2*a, b* illustrate a top view and a side view of a swimming device according to a second embodiment, FIG. 3*a, b, c* illustrate side views to illustrate a swimming movement.

FIG. 1*a* shows a top view and FIG. 1*b* a side view of a swimming device 1 for a swimmer 2, or diver 2, with exactly one fin 3, one power transfer element 4 for moving the fin 3 using muscle power, and a fastening device 5 for fastening the power transfer element 4 to both lower legs of the swimmer 2, whereby the power transfer element 4 comprises one lower leg section 500, one foot section 400, and a fin section 300, and mainly forms a linear brace. In addition, the swimming device 1 comprises an optional suit 6 with a leg section, which encloses the legs and feet of the swimmer 2 up to the fin 3 in order to reduce flow resistance so that stronger propulsion and higher swim speeds can be achieved.

At the same time, the feet can move freely. The ankles of the swimmer 2 are also not exposed to any, particularly considerable, strains because the strength required from the leg muscles, particularly the thigh muscles, for propulsion, is directly transferred to the power transfer element 4 and the fin 3 using the fastening device 5. To this end, the lower leg muscles are not needed for propulsion.

The fin 3 is designed as a monofin, which can be moved up and down as a fluke in +/−Z direction, namely using a primarily synchronous movement of both legs. In this way a large amount of power, mainly of the thigh muscles, is transferred to the fin 3, namely without stressing the ankles and lower leg muscles, compared to conventional diving fins which, with shoe-like forms, are fastened to the feet. When the swimming device 1 is used properly, the fin 3 is located along a long axis of the lower leg below the soles of the feet 26, so that in a resting position, namely when the body of the swimmer 2 is stretched out, it is also located along the long axis of the swimmer 2, and in this way enables the swimmer 2 to glide through the water with little resistance. Furthermore, an overstretching of the feet 26 which would strain the ankles 27 is avoided because they can be held in a largely relaxed position to the lower leg. The feet 26 can be laid on footrest 5*a*.

The fin 3 is designed, in particular, as a single piece, elastic, however, preferably of low flexibility, in order to transfer large forces into the water.

The power transfer element 4 is elastic, for instance made of a composite material, so that during up and down movement of the legs it can always be flexed in the opposite direction. In this way, the load peaks are curbed in order to increase the ergonomics of the swimming device and, in addition, a favourable inclined position of the fin 3 to a swimming device achieves greater propulsion.

The fastening device 5 includes a shin pad, which can be designed as a plate, which is provided with fasteners for the lower leg. In doing so, the fastening device 5 includes a locking device 5*b*, for example with textile straps, to secure it to the lower legs in the knee area and a locking device 5*c* in the ankle area. Apart from that, the power transfer element 4 is fixed on the fastening device 5.

Figure 1C:
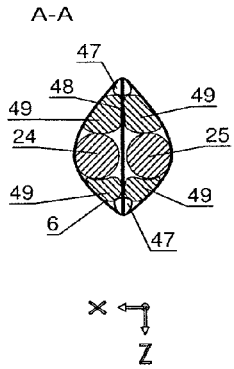

FIG. 1*c* shows a cross section of the swimming device 1, according to the invention, in the X-Z level approximately at the height of the ankle. The power transfer element is depicted as plate 48 and has form elements 47, which are rounded on both the front and back edge. The outer skin is formed by a suit 6. In the centre are the legs 24, 25 of the swimmer, which are fastened to the shin pad 48 using a locking device 5*c*. The power transfer element 4 is depicted in cross section, that is, lenticular or biconvex, in the X-Z level. As a result, when moving in the +/−Z direction, the laminar flow in this area is preserved, which is build up with a significantly more streamlined shape using the corresponding form elements 47 and fill elements 49, in contrast to the prior art. The exertion of force is thereby lower and the propulsion transferred to the fin 3, is noticeably higher.

Figure 2A:
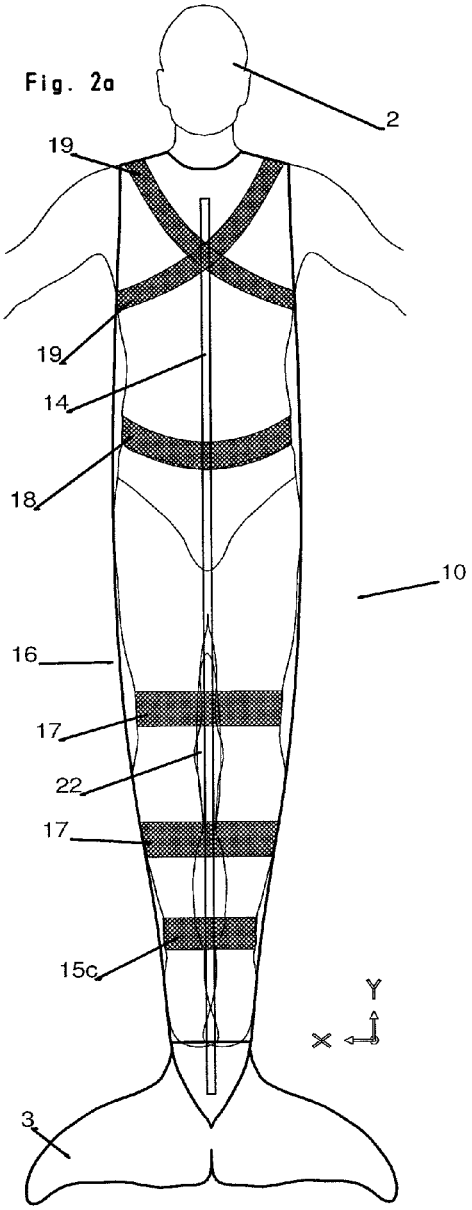
Figure 2B:
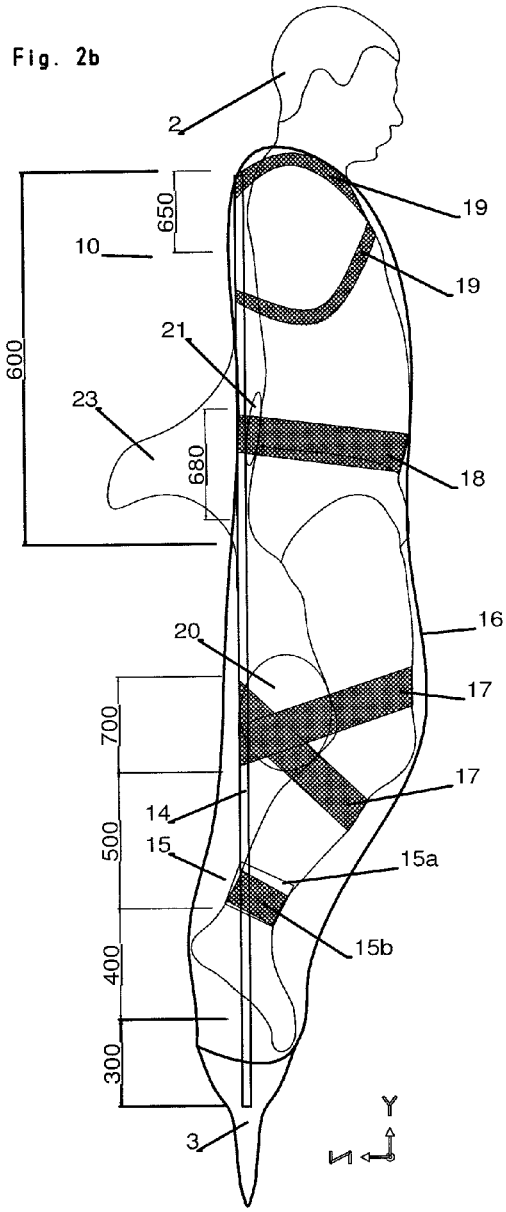

FIG. 2*a* shows a top view, and FIG. 2*b* a side view, of a swimming device 10 whereby only the differences from the swimming device 1 described in FIG. 1 will be explained below.

The power transfer element 14 is formed from a torso section 600, namely from an area of the swimmer's 2 shoulder to the fin section 300, so that the power transfer element 14, mainly runs along the spine and this effectively continues to the fin 3. Through this embodiment of the power transfer element 14 more muscles and body parts, in particular the entire leg musculature and significant parts of the torso musculature, are used for propulsion for swimming. The swimming movement is explained below for FIG. 3*a, b, c*. In addition, the swimmer 2 is supported by this embodiment and protected from strain, particularly in the lumbar spine.

The power transfer element 14 can, as described above, be fastened to the lower legs using a fastening device 15, whereby the power transfer element 14 is adjustably mounted (within limits) on the pre-form part 15*a*, 15*b* along the long axis.

In addition the swimming device 10 has three additional fastening devices 17, 18, 19, for example with textile straps, or a carrying frame similar to a backpack, or a safety harness, for fastening the power transfer element 14 to the body of the swimmer 2. The fastening device 17 is arranged in the knee area 700 with two straps, in the hip area 680 and in the shoulder area 650. At the same time, the fastening devices 17, 18, and 19 are designed with mounts for the power transfer element 14 and enable a secure coupling of the swimming device 10 with the legs and the torso. The mounts of the fastening devices 5, 15, 17, 18, 19 can be designed using elastomer bodies in order to realize a certain mobility of the power transfer element 4, 14 with regard to the body of the swimmer 2 for improved ergonomics and/or to decrease vibrations.

For the creation of the bending movement the swimming device 10 has cushions 20, 21 which are formed, for example, as elastomer bodies or gel cushions, and are arranged on the power transfer element 14, whereby they stretch, at least by section, between the power transfer element 14 and the body, during proper use of the swimming device 10. The swimming device 10 also preferably includes a cushion 22, for example an elastomer body or gel cushion, which can be arranged between the legs, in order to cushion both.

The cushion 20 is designed as a spacer in the knee section 700 between the legs and the power transfer element 14, in order to specify a resting position of the swimmer with slightly bent legs and in order to enable the swim movement described in FIG. 3*a, b, c* below. In this way the cushion 20 constitutes a bending device in the knee section 700 which is designed for the sectional bending of the power transfer element 14, i.e. also the fin 3.

The suit 16 comprises a leg section and a torso section 600 so that it stretches from the fin 3 to the shoulders of the swimmer 2 and thereby encloses the feet, the legs, and the torso for a better streamline shape. The suit 16 preferably includes a lock, which stretches at least sectionally, for example a zipper, in order to make it easier to put on the swimming device. In addition, the swimming device 10 includes an optional dorsal fin 23 in order to better stabilize the swimming position.

Figures 3A, 3B, 3C:
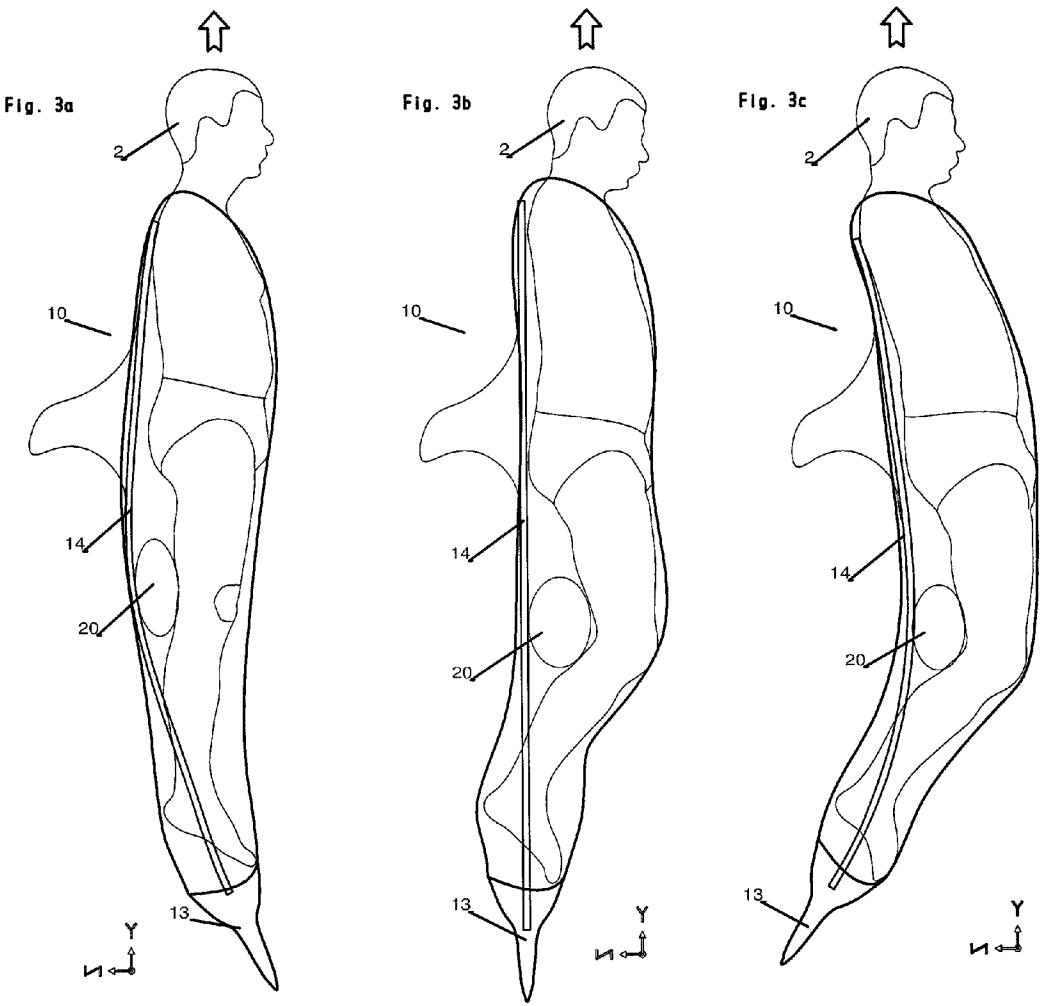

FIG. 3*a, b, c* shows a simplified side view of the swimming device 10 in accordance with FIG. 2, whereby from top to bottom the use of the swimming device 10 for a swimming movement by means of a first extreme position, a resting position, and a second extreme position, are depicted in the movement.

For the first extreme position the legs of the swimmer 2 are extended so that the power transfer element 14 is bent using the above described bending device, with the cushion 20 as a spacer between the remaining holding devices 15, 18, 19 which are not depicted here. One the one hand, energy is stored in the power transfer element during the bending of the elastic power transfer element 14, and on the other hand, the fin 13 in FIG. 3 is simultaneously pivoted downwards. In this way, a propulsion of the swimmer 2 is achieved namely in the direction of the arrow in FIG. 3*a*.

During the transition to the resting position, the energy stored in the power transfer element 14 is released whereby the power transfer element takes on its straight, unbent, form and the fin 13 is simultaneously moved upward so that propulsion is achieved. In doing so, the flexors, which can only transfer small amounts of force for a slight bending of the legs, are supported by the energy stored earlier in the power transfer element 14; therefore, the performance of the swimming device 10 is increased.

Starting from the resting position, the swimmer 2 achieves the second extreme position through increasing bending of the legs. In doing so, the power transfer element 14 is now bent in the opposite direction so that the fin 13 is moved upward for continual propulsion. In addition, energy is again stored in the power transfer element 14, which is used during a subsequent movement back to the resting position (FIG. 3*b*).

Figure 4:
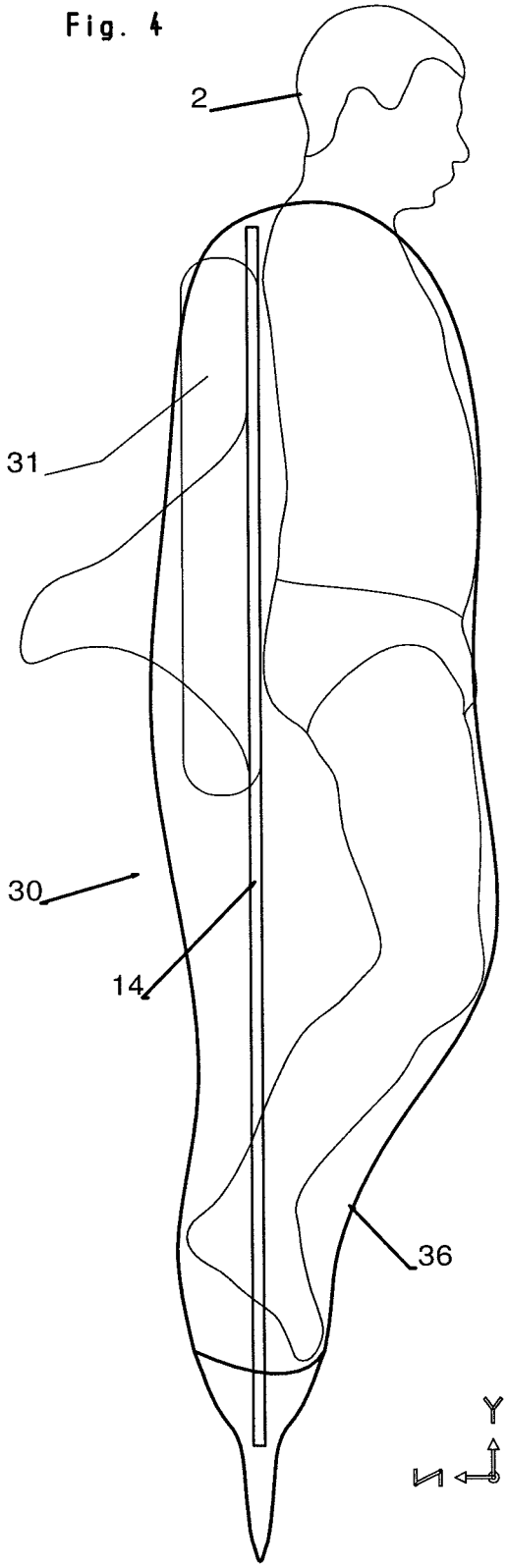
FIG. 4 is a side view according to a third embodiment.

FIG. 4 shows a simplified side view of a swimming device 30 which differentiates itself from the swimming device 10 shown in FIG. 2 in that it has holding devices, particularly pockets for a breathing air supply 31, for example with compressed air cylinders for dives with a compressed air device or closed circuit rebreather, on both sides of the power transfer element 14. In addition, the flow resistance is kept low by enclosing the breathing air supply 31 with the suit 36. All diagrams show only schematic, not true to scale, images. Furthermore, we especially refer to the drawings as significant for the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A swimming device for a swimmer or a diver, comprising:

a monofin having a laminar shape on a X-Y level and primarily movable in the +/−Z-direction;

a power transfer element for moving the monofin using muscle power in water and comprising a fastening device for fastening the power transfer element to a lower leg of the swimmer, the fastening device being formed as a shin pad, the power transfer element comprising a lower leg section, a foot section, and a fin section; and a hinge arranged between the power transfer element and the monofin, the hinge being movable during an operation of the swimming device, wherein the swimming device is in a cross section at a right-angle to the body axis, in the X-Z level lenticular with a long Z-axis and a short X-axis.

2. The swimming device according to claim 1, wherein form elements and fill elements are arranged on and around the shin pad.

3. The swimming device according to claim 1, wherein the hinge is a limited angle hinge arranged between the power transfer element and the monofin.

4. The swimming device according to claim 1, wherein the monofin has a laminar-oval shape in the Y-Z level with a long Y-axis and a short Z-axis.

5. The swimming device according to claim 1, wherein the power transfer element is a spring-elastic bracer.

6. The swimming device according to claim 1, further comprising an adjustment device for the adjustment of the angle between the monofin and the power transfer element, the adjustment device being provided on the monofin and the power transfer element.

7. The swimming device according to claim 1, further comprising an adjustment device for varying a stiffness of the monofin.

8. The swimming device according to claim 1, wherein the power transfer element extends from a torso of the swimmer to the monofin.

9. The swimming device according to claim 1, wherein the swimming device has at least three fastening devices for fastening the power transfer element to the body of the swimmer, the at least three fastening devices being arranged in the lower leg section, in a knee section and in a hip section as well as in a shoulder section and, is mainly designed as a linear, two dimensional bendable bracer from a shoulder section to the fin section.

10. A swimming device for a swimmer or diver, the swimming device comprising:

a monofin laminar shape on a X-Y level and primarily movable in the +/−Z-direction;

a power transfer element for moving the monofin using muscle power;

a fastening device for fastening the power transfer element to lower legs of the swimmer, the fastening device having a shin pad, wherein the power transfer element includes a fastening section, a foot section, and a fin section; and a hinge arranged between the monofin and the fin section of the power transfer element, the hinge being movable during an operation of the swimming device, wherein the power transfer element is arranged between the lower legs of the swimmer.

11. The swimming device according to claim 1, wherein the fin is located along a long axis of the lower leg below the soles of the foot section.

12. The swimming device according to claim 1, wherein the swimming device comprises a limited angle hinge with a hinged joint between the power transfer element and the monofin.

13. The swimming device according to claim 1, wherein the power transfer element is a spring-elastic bracer from a rod-shaped bracer.

14. The swimming device according to claim 1, wherein the power transfer element is a spring-elastic bracer from a rod-shaped bracer with sectional varying stiffness.

15. The swimming device according to claim 1, further comprising an adjustment device for varying mobility stiffness relative to the power transfer element.

16. The swimming device according to claim 1, wherein the power transfer element extends from a torso section to the fin section, and wherein a bending device, over the knee section, for the bending of the power transfer element is provided at the end of the fin section.

17. The swimming device according to claim 9, wherein the swimming device has at least four fastening devices for fastening the power transfer element from the shoulder section to the fin section.

18. The swimming device according to claim 9, wherein the bracer, from the shoulder section to the fin section, is pre-stressed.

19. A swimming device comprising:

a monofin having a fluke shape and a rigid portion and a flexible portion;

a power transfer element for moving the monofin using muscle power, the power transfer element extending at least from a knee area or an area immediately below a knee of a swimmer towards the monofin;

a fastening device adapted to fixedly hold the power transfer element to at least two separate areas of a lower leg of the swimmer via a shin pad; and a movable hinge arranged between the monofin and an end portion of the power transfer element, the movable hinge being movable during an operation of the swimming device, wherein the power transfer element is arranged between lower legs of the swimmer, wherein the power transfer element is directly connected to the movable hinge.

20. The swimming device according to claim 19, wherein the power transfer element is rigid.

21. The swimming device according to claim 19, wherein the power transfer element is configured such that it only extends between the lower legs of the swimmer.

22. A swimming device comprising:

a monofin having a fluke shape and a rigid portion and a flexible portion;

a power transfer element for moving the monofin using muscle power, the power transfer element extending at least from a upper back area a swimmer towards the monofin;

a fastening device adapted to fixedly hold the power transfer element to the swimmer at an area of an upper torso of the swimmer and at a lower leg area of the swimmer; and a movable hinge arranged between the monofin and an end portion of the power transfer element, the movable hinge being movable during an operation of the swimming device;

a cushion arranged between a knee area of the swimmer and the power transfer element, the cushion being fixedly mounted to the power transfer element, the cushion facilitating a bending of the power transfer element in a swimming axis via leg muscle power of the swimmer, wherein the power transfer element is configured such that a portion thereof extends between lower legs of the swimmer.

23. The swimming device according to claim 22, wherein the movable hinge is directly connected to the power transfer element.

* * * * *